United States Patent [19]

Möller

[11] 4,375,144

[45] Mar. 1, 1983

[54] LID MOUNTING APPARATUS

[76] Inventor: Knut N. A. Möller, Börgasgårdsvägen 14, Halmstad, Sweden

[21] Appl. No.: 198,144

[22] PCT Filed: Feb. 28, 1980

[86] PCT No.: PCT/SE80/00055

§ 371 Date: Oct. 14, 1980

§ 102(e) Date: Oct. 14, 1980

[87] PCT Pub. No.: WO80/01788

PCT Pub. Date: Sep. 4, 1980

[30] Foreign Application Priority Data

Mar. 1, 1979 [SE] Sweden ..... 7901849

[51] Int. Cl.[3] ..... B65B 7/28

[52] U.S. Cl. ..... 53/309

[58] Field of Search ..... 53/309, 305, 319, 328, 53/324, 306; 221/297, 292, 293

[56] References Cited

U.S. PATENT DOCUMENTS

| | | | |
|---|---|---|---|
| 1,050,788 | 1/1913 | Baltzley | 53/309 X |
| 1,233,468 | 7/1917 | Heath | 53/309 |
| 2,050,895 | 8/1936 | Petersen | 53/305 |
| 2,088,010 | 7/1937 | Petersen | 53/305 |
| 3,864,898 | 2/1975 | West | 53/309 X |
| 3,905,178 | 9/1975 | West | 53/309 X |

*Primary Examiner*—Horace M. Culver

*Attorney, Agent, or Firm*—Beveridge, DeGrandi & Kline

[57] ABSTRACT

The present invention relates to an apparatus for mounting lids (17, 18) on containers (12) of different types, for example cans, pails etc. The basis of the present invention resides in the object of mounting lids on filled containers in as simple and functionally reliable manner as possible. Furthermore, it is desirable that the container, after filling, need not be moved with a loosely recumbent lid thereon. A lid mounting apparatus according to the present invention is characterized in that a lid magazine (16) is located above a container hoist (9, 10) such that first means (32, 33) are disposed between the lid magazine (16) and the container hoist (9, 10) for separating one lid (18) from the lid magazine (16) and retaining the remaining lids (17) in the magazine (16) while the separated lid is released downwardly, and second means (19, 20) located in the path of movement of the separated lid and forming a bottom in the lid magazine (16) and abutment against which the container (12) with the separated lid (18) is pressed by means of the container hoist (9, 10) for final mounting of the lid (18).

9 Claims, 2 Drawing Figures

LID MOUNTING APPARATUS

BACKGROUND OF THE INVENTION

The present invention relates to an apparatus for mounting lids on containers of different types, for example cans, pails etc.

THE STATE OF THE ART

In prior art installations for filling containers, for example pails, cans etc of plastic or similar material, the sealing of the containers is effected by means of some suitable type of lid. In most cases, it desirable that the lid be of such a type as can later be removed and remounted in place for optional opening and closing of the container. In many prior art installations for filling containers, for example plastic pails, with paint and the like, a lid is positioned on the container at one station in the installation and the container is then conveyed with the loosely positioned lid to another station in the installation where it is pressed into place on the container.

Primarily, the movement of the containers with a loosely-positioned lid from one point to another before the container is finally sealed with the lid entails many problems. During this movement operation, the position of the lid may change, which demands a centering of the lid before the final pressing operation, and the contents of the container can splash up onto the edges between the lid and the container and thereby render final, tight sealing and subsequent opening and closing more difficult. One object of the present invention is to realise a lid mounting apparatus in which the above-outlined problems are obviated. A further object is that it should be possible for such a lid mounting apparatus to be utilised for several different lid dimensions without requiring too extensive alterations and operational down-time.

SUMMARY OF THE INVENTION

The above-mentioned objects of the present invention are attained in the apparatus disclosed by way of introduction which is characterised in that a lid magazine or store is located above a container hoist, that first means are disposed between the lid magazine and the container hoist for separating one lid from the lid magazine and retaining the remaining lids in the magazine, while the separated lid is downwardly released, and second means which, after the downward release of the separated lid, are moved into its path of movement and form a bottom in the lid magazine, and an abutment against which the container with the separated lid is pressed by means of the container hoist for finally mounting the lid.

In a lid mounting apparatus according to the present invention, a container need not be laterally shifted, the lid being instead positioned on the container and pressed onto the container without any lateral shifting of the container whatsoever. Since both the mounting and pressing of the lid take place in one and the same station in which the filled container is hoisted up to the lid and forced thereinto, all parts which are dependent upon lid and container dimensions in the lid mounting apparatus are reduced to a minimum and, thereby, alterations for adaptation to different lid and container dimensions can be effected very rapidly, since few adjustments in the apparatus are required.

DESCRIPTION OF THE ACCOMPANYING DRAWINGS

One embodiment of the present invention will be described in greater detail below with reference to the accompanying drawings.

DETAILED DESCRIPTION OF THE PREFERRED EMBODIMENT

Figure 1:
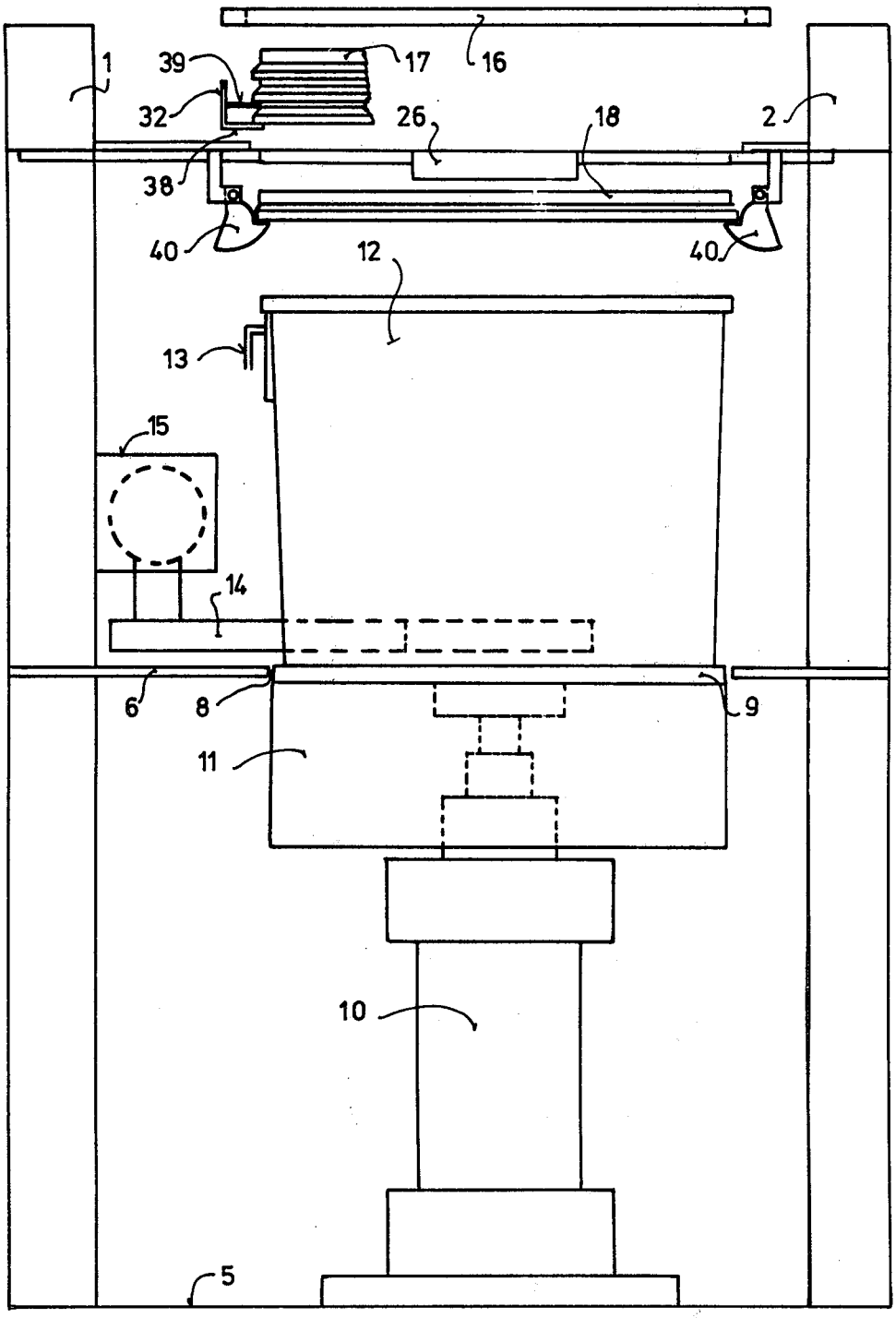
FIG. 1 illustrates a schematic side elevation of one embodiment of an apparatus according to the present invention.

The embodiment, shown on the drawings, of an apparatus according to the present invention has a frame with four corner posts 1, 2, 3, and 4. The corner posts 1–4 extend upwardly from a substrate 5 and support, a distance above the substrate, a table-like platform 6 with an opening 8 for a plate 9 of a container hoist which, in principle, consists of a piston and cylinder assembly 10. The piston and cylinder assembly is mounted on the substrate 5 and its plate 9 has a guide and protection collar 11. The table 6 and the plate 9 are located on a level with conveyor paths in an installation for filling different types of containers, for example pails, cans etc, in which the illustrated apparatus according to the present invention is disposed. The container shown in FIG. 1 is a plastic pail 12 and may, as is intimated, be provided with a grip 13.

After application of a lid, the pail 12 with the lid is moved out of the lid mounting apparatus and, to this end, an arm 14 is disposed slightly above the table 6. The arm 14 is reciprocal by means of a piston and cylinder assembly 15.

The four posts 1–4 support, above the table 6, a lid magazine or store (not shown) which may be of any optional suitable construction and is mounted on a collar 16. The collar is illustrated at the top of FIG. 1 and is mounted by means of suitable members on the four frame posts 1–4. The collar 16 may be fixedly mounted or shiftably mounted on the frame posts 1–4 for adaptation of the height between the collar 16 and table 6 to the height of the pail 12 or other containers which are to be provided with a lid.

The collar 16 forms, as was mentioned above, one end of a lid magazine and, in FIG. 1, there is intimated a section of a stack with a number of lids 17. Furthermore, FIG. 1 also shows a lid 18 in a position slightly before it is to be mounted on the container 12.

Figure 2:
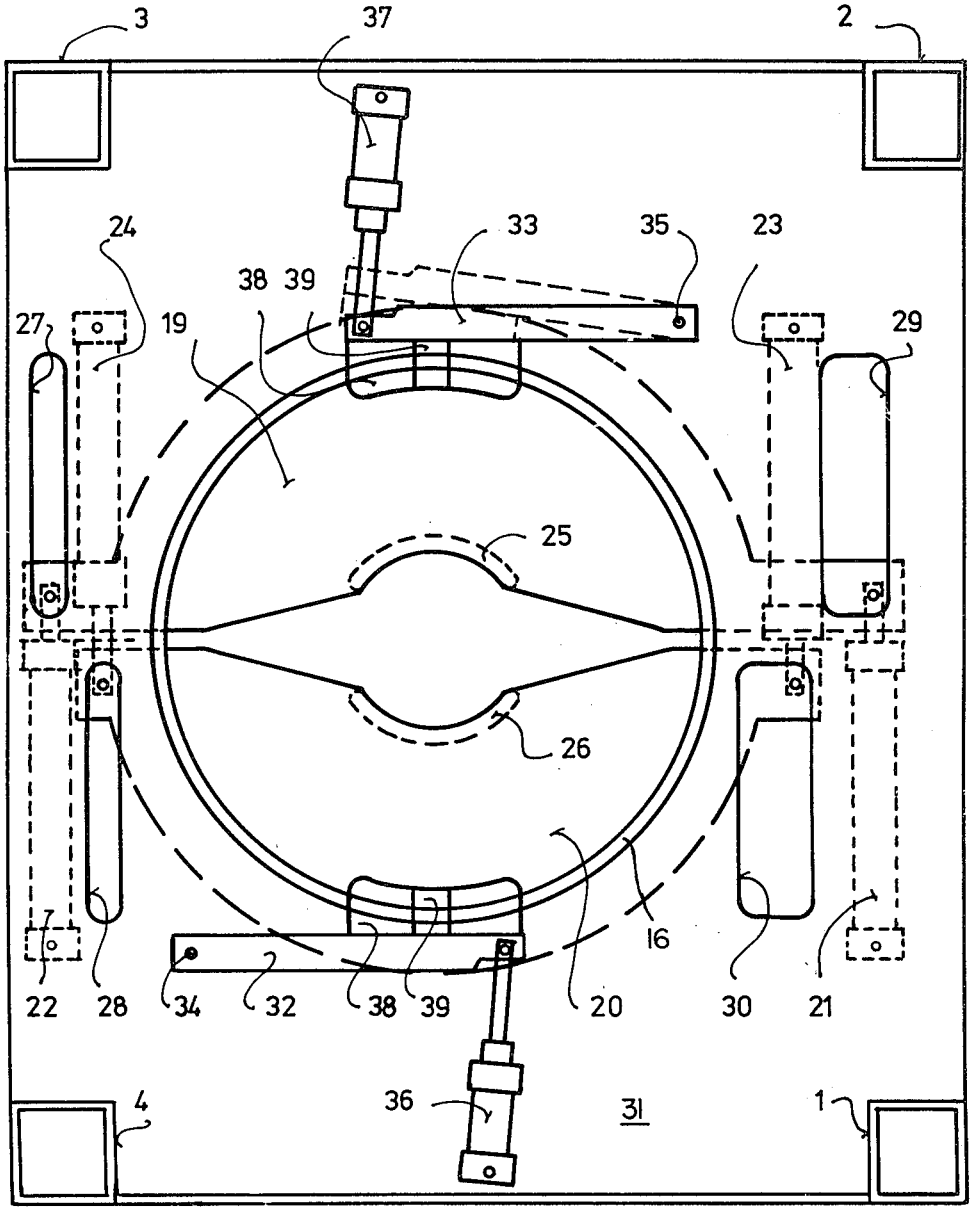
FIG. 2 is a schematic top plan view of a fundamentally similar apparatus to that of FIG. 1, a number of the parts shown in FIG. 2 having been omitted from FIG. 1 for purposes of clarity.

FIG. 2 illustrates the upper section of the apparatus with the collar 16 in greater detail. The opening defined by the collar 16 is sealed by means of two hatches 19 and 20. The hatches 19 and 20 are each outwardly shiftable away from one another from the position shown in FIG. 2 for exposing the opening defined by the collar by means of their respective piston and cylinder assembly 21, 22; and 23, 24. Bosses 25 and 26, respectively are centrally disposed on the hatches 19 and 20. The shifting movement of the hatches 19 and 20 is guided by means of grooves 27, 28, 29, and 30 in a plate 31 above which the collar 16 is disposed.

Furthermore, two arms 32 and 33 are pivotally disposed on the plate 31. The arms 32, 33 are pivotal at 34 and 35 respectively, and the pivotal movement of the arms 32 and 33 is executed by means of an associated piston and cylinder assembly 36 and 37, respectively. At the opposite end of the arms 32, 33 with respect to the pivot axes 34, 35, the arms support a plate 38 whose face located towards the opening is arcuate, and the plate 38 is, as is shown in greater detail in FIG. 1, to engage under the lid 17. The plates 38 will, thus, retain the lid 17 in the lid magazine irrespective of the position of the hatches 19 and 20. As is indicated at the top of FIG. 2, the arms 32 and 33 may, however, be pivoted by means of the piston and cylinder assemblies 36 and 37 to the extent which is shown by the broken lines for the arm 33. With the arms 32 and 33 in the position shown by means of broken lines, the lid 17 will fall down onto the hatches 19 and 20.

In order to prevent more than one lid from falling down through the opening in the collar 16 when the hatches 19 and 20 are moved aside from the position shown in FIG. 2, the arms 32 and 33 are retracted to the position shown on the drawings, in which the plate 38 engages under the lid 17 as is shown in FIG. 1, and a lug 39 disposed above the plate 38 projects in between the lids 17. The lug 39 is also fixedly mounted on the arms 32 and 33, like the plate 38. The purpose of the lug is to centre the lid stack 17 between the plates 38 so that the plates 38 will not come into contact with the lowermost lid in the stack. The lowermost lid in the stack is now located on the hatches 19 and 20.

When the hatches 19 and 20 are shifted out of the position shown in FIG. 2 and expose the opening in the collar 16, the lid located on the hatches will be released from the remaining lids in the stack and fall down through the opening to the position, shown in FIG. 1 for the lid 18, on a number of catches 40 which are pivotally mounted in a ring about the opening in the collar 16. The catches are weight-balanced such that they always assume the position shown in FIG. 1 in which the lid 18 is prevented from falling down onto the container 12.

After downward release of the lid 18, the hatches 19 and 20 return to the position shown in FIG. 2, in which the bosses 25 and 26 on the hatches 19 and 20 are located centrally with respect to the lid 18 as is shown in FIG. 1. With the lid 18 and hatches 19 and 20, and, thereby, the bosses 25 and 26, in the position shown in FIG. 1, the container 12 is lifted by means of the container hoist 10 and, on passage by the catches 40, these will be pivoted outwardly and allow by-pass of the container 12 into engagement with the lid 18. As the container 12 continues to be lifted by means of the piston and cylinder assembly 10, lid 18 comes into contact with the bosses 25 and 26, whereby the lid 18 is depressed inwardly towards the interior of the container 12 in its central portion, before the edges of the lid 18 come into contact with the underface of the hatches 19 and 20, and is pressed onto the container 12. As a result of this inward depression, an advantageous air-evacuation of the container will be released immediately before sealing of the container. The catches 40 are maintained in their outwardly pivoted position by the container 12, so that the container can be lowered past the catches 40 with the impressed lid, without the catches 40 interfering with the lid 18.

Even though the mode of operation of the apparatus may be read from the above description, this mode will be briefly illustrated. It should, here, be observed that all of the piston and cylinder assemblies are air-driven, but it is obvious to the skilled reader that other drive forces may be utilised. The lid stack 17 rests on the hatches 19 and 20, and the arms 32 and 33 are in the position illustrated in FIG. 2 by means of solid lines, the catches being located in the position shown in FIG. 1. When the hatches 19 and 20 are moved by means of the piston and cylinder assemblies 21–24 to their extreme position, one lid 18 falls down onto the catches 40. After return of the hatches 19 and 20, the arms 32 and 33 are pivoted, whereupon the lid stack 17 falls down onto the hatches 19 and 20 and the arms 32, 33 are pivoted back to the position shown in FIG. 2 and thereby centre the lid stack 17 by means of the lugs 39, and grasp the lowermost lid by means of the plate 38 for ensuring that no more than one lid falls down through the opening. The lid 18 located on the catches 40 is pressed onto a container 12 and the catches return to their initial position after lowering of the container 12 by means of the piston and cylinder assemblies. The sequence of movements of the various parts may be controlled in any optionally desired manner and may be adapted to other movements in a filling installation. After lowering of the container 12 with a lid 18 in final position, the plate 9 assumes the position shown in FIG. 1 and the piston and cylinder assembly 15 may move out the container 12 from the apparatus by means of the arm 14.

The apparatus may readily be adapted to other lid and container dimensions than those shown on the drawings. Frame post sections of different lengths may be inserted between the plate 31 and the posts 1–4 for optional height between the plate 31 and the table 6. Furthermore, the plates 38 and the lugs 39 can quite easily be adapted to other lid sizes. Finally, the catches 40 may be pivotally disposed on shiftable arms.

What is claimed is:

1. An apparatus for mounting lids on containers characterized in that a lid magazine having a vertical axis is located above a container hoist, that first means is disposed between the lid magazine and the container hoist and includes opposed movably members centered on said axis for separating one lid from the lid magazine and retaining the remaining lids in the magazine while allowing downward release of the separated lid, and second means including opposed movable members centered on said axis in the path of movement of the separated lid and forming a biottom in the lid magazine, and an abutment with a depending boss against which the container with the separated lid is pressed by means of the container hoist for final mounting of the lid.

2. Apparatus according to claim 1, characterized in that said second means comprise shifting hatches which form a bottom in the lid magazine and on which the lids rest, and that said first means comprises arms which are adjustable into engagement with the next-lowermost lid in the lid magazine for retention of the lids in the magazine apart from the lowermost lid which, after removal of the shifting hatches falls down onto lid catches.

3. Apparatus according to claim 2, characterized in that one end of the arms has a first shank for insertion under the edge of the next lowermost lid, and a second shank for centering at least the next lowermost lid.

4. Apparatus according to claim 3, characterized in that one end of the first shank for engagement with the lid edge is arcuate for ensuring engagement with the lid edge.

5. Apparatus according to claim 2, characterized in that said boss disposed centrally on the underface of the shifting hatches for depressing the lid depresses the central portion of each lid towards the container before said lid is pressed onto the container.

6. Apparatus according to claim 2, characterized in that the lid catches consist of a number of catches which are pivotally mounted in a ring beneath the shifting hatches and which, in their position of rest, project into the path of movement of the lid in order to prevent continued fall of same, and to retain the lid until the container is lifted by means of the container hoist, the container moving aside the catches so that the lid comes to rest on the container and is pressed into position on the container under abutment against the shifting hatches, the catches being moved aside while the container is lowered, and until the finally mounted lid has passed.

7. An apparatus for mounting lids having a given thickness on containers comprising a frame having a substrate, a container hoist mounted on said substrate, post means extending upward from said substrate, a lid magazine for holding a stack of lids supported by said post means, said magazine defining a vertical axis, opposed hatches supported by said post means between said container hoist and said magazine cooperably radially movable toward and away from said axis between first positions in which hatches block vertical movement of the lowermost lid from said magazine toward said container hoist to second positions in which they allow such lid movement, a first plate and lug means, said plate and lug of said means being vertically separated from one another by a distance slightly less than said lid thickness, and being connected together, said plate and lug means supported by said post means at a height at which said plate means is immediately below the next lowermost lid and said lug means is at a height between said next lowermost lid and the next higher lid and adapted for horizontal movement from a first position in which said plate is in engagement with the next lowermost lid to a second position in which said plate and lug are out of contact with any of said stack of lids, a second plate and lug means at the same height as said first plate and lug means movable between similar first and second positions and cooperable with said first plate and lug means to provide support for the next lowermost lids contacted by said plates, bosses centrally depending from said hatches, and actuating means for said plate and lug means and said hatches whereby said plate and lug means can be maintained in their first positions while said hatches are moved from their first to second positions to allow said lowermost lid to fall toward a container on said container hoist, said hatches can be moved back to their first positions, said container can be hoisted by said container hoist to press said lid onto said container against said bosses to depress a central portion of said lid and then to engage said lid on said container by continued hoisting of said container against said hatches, said plate and lug means can be moved from their first to second positions to allow said stack of lids to drop down onto said hatches, and said plate and lug means can be returned to their first positions.

8. An apparatus as claimed in claim 7 wherein said plates are flat and substantially parallel to said lids and each plate has an arcuate edge facing said vertical axis.

9. An apparatus as claimed in claim 7 further comprising a horizontal ring centered on said axis supported by said post means between said hatches and said hoist, said ring having pivotally mounted thereon a number of catches which in a rest position project into the path of movement of a lid falling from said hatches to prevent the continued fall of said lid and to retain the lid until the container is hoisted by means of the container hoist sufficiently to pivot said catches out of the rest position so that the lid comes to rest on said container for further hoisting of said lid and container against said bosses and hatches, said catches remaining out of their rest position until said container and lid have been lowered by said container hoist.

* * * * *